US008602735B1

(12) United States Patent
Liang

(10) Patent No.: US 8,602,735 B1
(45) Date of Patent: Dec. 10, 2013

(54) TURBINE BLADE WITH DIFFUSER COOLING CHANNEL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 333 days.

(21) Appl. No.: 12/951,607

(22) Filed: Nov. 22, 2010

(51) Int. Cl.
*F01D 5/08* (2006.01)

(52) U.S. Cl.
USPC ..... 416/97 R

(58) Field of Classification Search
USPC ..... 415/115; 416/96 A, 96 R, 97 R
See application file for complete search history.

(56) References Cited

U.S. PATENT DOCUMENTS

| | | | | |
|---|---|---|---|---|
| 4,236,870 | A * | 12/1980 | Hucul et al. | 416/97 R |
| 4,820,122 | A * | 4/1989 | Hall et al. | 416/97 R |
| 5,403,159 | A * | 4/1995 | Green et al. | 416/97 R |
| 6,874,992 | B2 * | 4/2005 | Dailey | 416/96 R |
| 7,547,190 | B1 * | 6/2009 | Liang | 416/97 R |
| 7,654,795 | B2 * | 2/2010 | Tibbott | 416/97 R |
| 8,297,925 | B2 * | 10/2012 | Barrett | 416/92 |

* cited by examiner

*Primary Examiner* — Nathaniel Wiehe
*Assistant Examiner* — Woody A Lee, Jr.
(74) *Attorney, Agent, or Firm* — John Ryznic

(57) ABSTRACT

A turbine blade with small diffusers in the cooling channels and trip strips on the channel walls to produce a very high internal convection. A trailing edge cooling channel includes a diffuser on a lower end of the channel formed by ribs with decreasing width. A forward flowing serpentine flow cooling circuit includes a tip turn and a root turn with a small diffuser formed by the tip turn and a small diffuser formed on a lower end of the third leg of the serpentine formed by ribs with decreasing width.

13 Claims, 2 Drawing Sheets

TURBINE BLADE WITH DIFFUSER COOLING CHANNEL

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a turbine rotor blade with serpentine flow cooling channels.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

To provide higher efficiency, a blade must have higher cooling capability as well as using less cooling air flow. In future industrial gas turbine engines, the turbine blades will be longer and require less cooling air flow to improve control of metal temperature so that longer life for the blade occurs. Modern turbine blades use a combination of convection cooling, impingement cooling and film cooling.

BRIEF SUMMARY OF THE INVENTION

A turbine rotor blade with serpentine flow cooling channels with channel turns formed as small diffusers to diffuse the cooling air flow and achieve a super high internal convection with a low cooling flow rate. Small diffusers are used with trip strips in the straight channels to increase a heat transfer effect. The small diffusers are located at the root turn and the tip turn and act to increase a stiffness of the blade. A trailing edge cooling channel includes ribs on the lower end of the channel that form a diffuser and increase the stiffness of the blade in this section.

DETAILED DESCRIPTION OF THE INVENTION

Figure 1:
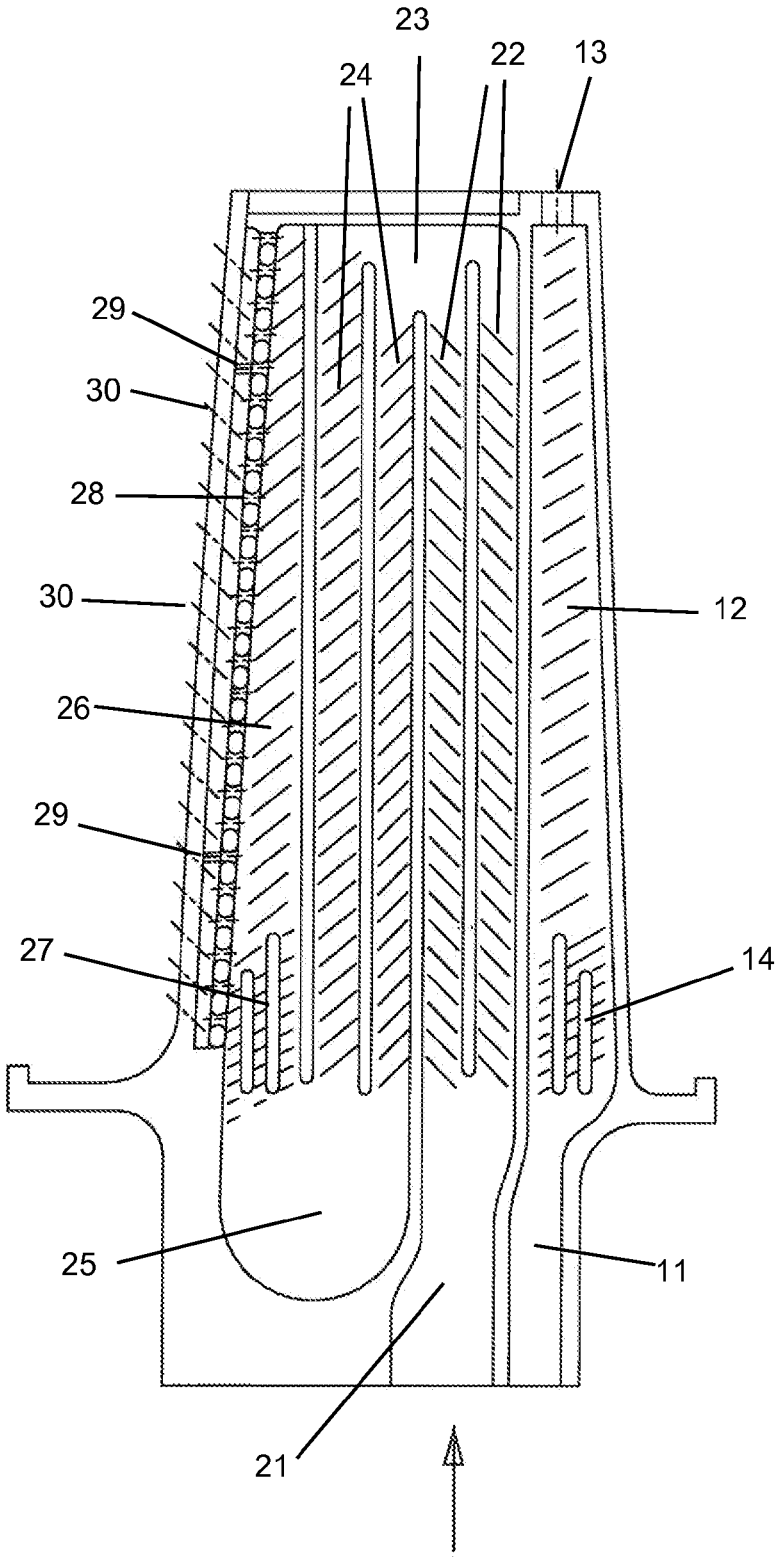
FIG. 1 shows a cross section view of the blade of the present invention with the cooling flow channels and small diffusers.
Figure 2:
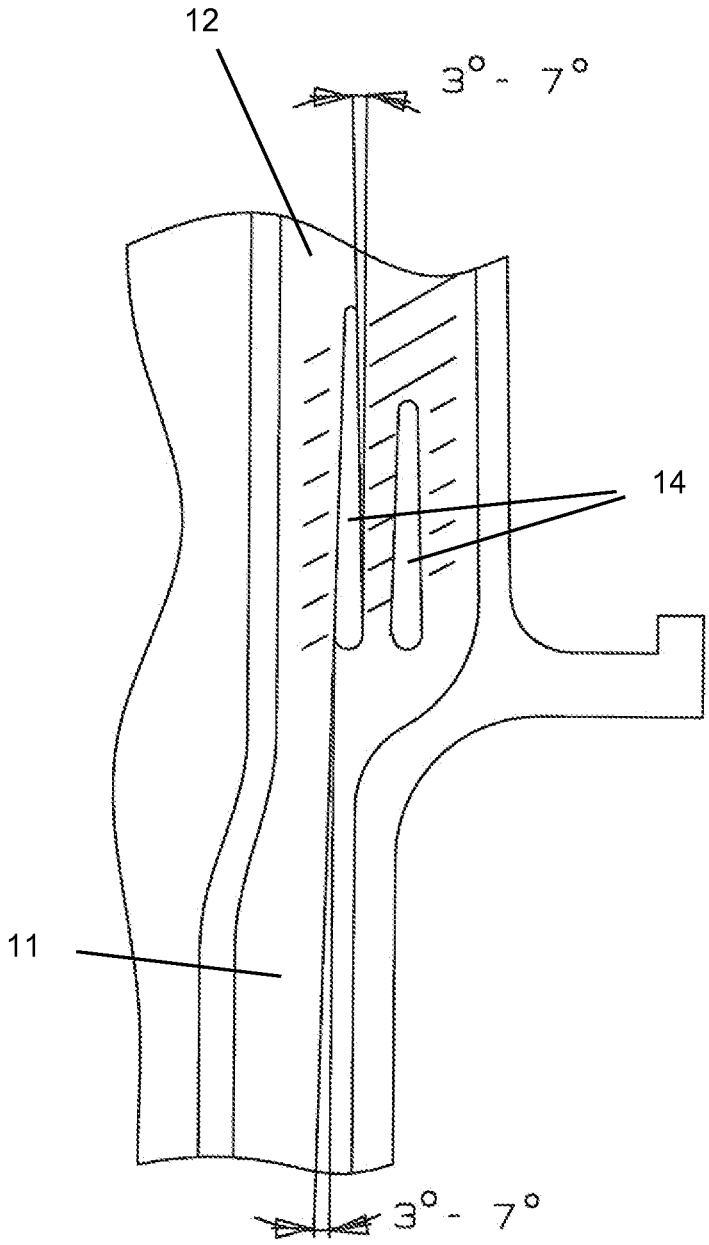
FIG. 2 shows a detailed view of the small diffuser in the trailing edge cooling passage of FIG. 1.

A turbine rotor blade with a serpentine flow cooling circuit in which a tip turn and a root turn of the serpentine flow circuit are formed as small diffusers and trip strips are used in the radial channels to produce a super high internal convection with a low cooling flow rate. FIG. 1 shows the blade with trailing edge cooling channel 12 having a small diffuser 14 at a lower end of the channel 12 and a three-pass forward flowing serpentine flow cooling circuit with a tip turn 23 formed as a small diffuser and a root turn 25 formed as a small diffuser. The trailing edge radial channel 12 is supplied through a root supply channel 11 and discharges the cooling air through a tip cooling hole 13. The trailing edge diffuser 14 is formed from a number of radial ribs (FIG. 2) that have a decreasing width in a direction of the cooling air flow to produce a diffusion effect. In this embodiment, two ribs are used. The trailing edge radial cooling channel 12 decreases in flow cross sectional area in a direction of the cooling air flow. Trip strips are used on the walls of the channel 12 to promote turbulence and increase the heat transfer rate from the hot metal surface to the cooling air. The ribs that form the diffuser 14 have sides that are angled at three to seven degrees to form the diffuser.

The blade mid-chord region is cooled with a three-pass forward flowing serpentine flow cooling circuit supplied by a root channel 21 that flows into a first leg or channel 22 that includes a radial rib to form the first leg 22 with two parallel channel. The first leg 22 turns into the second leg 24 at a tip turn that forms a tip turn diffuser 23. The tip turn diffuser 23 is created by forming both the first and second legs 22 and 24 from two parallel channels and with shortening the rib that separates the two legs as seen in FIG. 1.

The second leg 22 of the serpentine turns and flows into a third leg or channel 26 through a root turn 25. A lower end of the third leg 26 includes ribs 27 that form the root turn diffuser. The ribs 27 also have a decreasing width in the direction of the cooling air flow like the ribs 14 in the trailing edge channel to form a diffuser. Trips strips are also used in the channels of the serpentine flow circuit to increase turbulence and increase the heat transfer rate. The third leg 26 has a decreasing cross sectional flow area in the direction of the cooling air flow.

The cooling air flowing in the third leg 26 flows through a row of metering and impingement holes 29 and into a leading edge impingement cavity to cool the leading edge region of the blade. A showerhead arrangement of film cooling holes 30 are connected to the leading edge impingement cavity to discharge the cooling air as film cooling air. In this embodiment, the leading edge impingement cavity is formed from a number of separate cavities by ribs 29. Each separate impingement cavity can be designed for cooling flow rate and pressure based on the external hot gas pressure and temperature in order to control a metal temperature of the airfoil leading edge region.

The blade cooling channels with the diffusers of the present invention is used for a cooling channel at the blade root section where the cooling channel is at its maximum height with a large cross sectional flow area. This design is especially useful for a low cooling flow rate application. A squealer pocket is formed on the blade tip from tip rails that extend around the airfoil tip.

In operation, cooling air flow is supplied to the main flow channels from the airfoil attachment and into the trailing edge channel and the first leg of the serpentine flow circuit. As the cooling air flows through the small diffuser in the trailing edge channel, a new boundary layer is formed at the beginning of the small diffuser 14 and generates a very high rate of heat transfer coefficient to greatly reduce the airfoil root section metal temperature and enhance blade stress rupture capability.

Cooling air form the serpentine root supply channel 21 flows through the three legs and turns at the tip turn diffuser and the root turn diffuser to produce similar effects in the cooling air flow. The cooling air from the third leg is then passed through the metering and impingement holes to produce impingement cooling on the backside wall of the leading edge region and then is discharged as layers of film cooling air onto the external surface of the airfoil.

Major benefits of the cooling channel with small diffusers are described below. The small diffusers increase the internal convection surface area and therefore enhance the overall cooling effectiveness at the blade root section. The small diffusers provide additional stiffness for the airfoil root section, especially for the blade trailing edge region. The small diffusers break down the large open flow channel into a series of smaller parallel channels to increase the through-flow velocity of the cooling air and generate a higher heat transfer coefficient. The small diffusers eliminate the airfoil root section recirculation and separation problems for a blade with a wide root section.

I claim the following:

1. A turbine rotor blade comprising:

a leading edge region with a showerhead arrangement of film cooling holes connected to a leading edge impingement cavity;

a trailing edge region with a trailing edge cooling channel extending from a root to a tip of the blade;

a forward flowing serpentine flow cooling circuit to cool a mid-chord section of the blade;

a diffuser formed at a lower end of the trailing edge cooling channel; and the diffuser includes a radial extending rib with a decreasing taper.

2. The turbine rotor blade of claim 1, and further comprising:

the forward flowing serpentine flow cooling circuit includes a tip turn and a root turn;

the tip turn forms a tip turn diffuser; and, a third leg of the serpentine flow cooling circuit includes a diffuser on a lower end of the channel.

3. The turbine rotor blade of claim 1, and further comprising:

the blade is without trailing edge exit holes or slots; and, the trailing edge cooling channel is connected to a tip hole to discharge cooling air from the channel.

4. The turbine rotor blade of claim 2, and further comprising:

the trailing edge cooling channel and the serpentine flow channels have trip strips on the channel walls.

5. The turbine rotor blade of claim 2, and further comprising:

the third leg of the serpentine flow cooling circuit has a decreasing flow area in a direction of the cooling air flow.

6. The turbine rotor blade of claim 1, and further comprising:

the trailing edge channel diffuser is formed from a plurality of radial extending ribs that have decreasing thickness in a direction of cooling air flow.

7. The turbine rotor blade of claim 5, and further comprising:

the first and second legs have a constant cross sectional flow area.

8. The turbine rotor blade of claim 1, and further comprising:

the trailing edge cooling channel has a decreasing flow area in a direction of the cooling air flow.

9. The turbine rotor blade of claim 2, and further comprising:

the third leg of the serpentine flow cooling circuit is connected to the leading edge impingement cavity through a row of metering and impingement holes.

10. A turbine rotor blade comprising:

a trailing edge region cooling air channel extending from a root section of the blade to a blade tip section;

a trailing edge cooling channel diffuser formed in a lower end of the trailing edge region cooling air channel;

the trailing edge cooling channel diffuser including a plurality of radial extending ribs each having a decreasing taper;

a forward flowing serpentine flow cooling circuit with a first leg and a second leg each having twin channels separated by a channel divider rib;

the first leg and the second leg being separated by a leg divider rib;

a tip turn diffuser formed at a turn from the first leg into the second leg; and, the leg divider rib having a lower radial height that the two channel divider ribs.

11. The turbine rotor blade of claim 10, and further comprising:

a second tip turn diffuser formed at a turn from the second leg into a third leg;

a third leg diffuser formed in a lower end of the third leg; and, the third leg diffuser including a plurality of radial extending ribs each having a decreasing taper.

12. The turbine rotor blade of claim 10, and further comprising:

the trailing edge region cooling channel includes a tip cooling hole with no trailing edge exit slots or holes.

13. The turbine rotor blade of claim 11, and further comprising:

the third leg is located adjacent to a leading edge region cooling circuit with a showerhead arrangement of film cooling holes; and, a row of metering and impingement holes connects the third leg to the film cooling holes.

* * * * *